US011767716B2

(12) United States Patent
Püttmann

(10) Patent No.: US 11,767,716 B2
(45) Date of Patent: Sep. 26, 2023

(54) DRILLING HEAD FOR A PERCUSSIVE DISPLACEMENT GROUND DRILLING DEVICE AND USE OF A DRILLING HEAD FOR A PERCUSSIVE DISPLACEMENT GROUND DRILLING DEVICE

(71) Applicant: TRACTO-TECHNIK GmbH & Co. KG, Lennestadt (DE)

(72) Inventor: Franz-Josef Püttmann, Lennestadt (DE)

(73) Assignee: TRACTO-TECHNIK Gmbh & Co. KG, Lennestadt (DE)

( * ) Notice: Subject to any disclaimer, the term of this patent is extended or adjusted under 35 U.S.C. 154(b) by 0 days.

(21) Appl. No.: 17/404,072

(22) Filed: Aug. 17, 2021

(65) Prior Publication Data

US 2022/0056765 A1 Feb. 24, 2022

(30) Foreign Application Priority Data

Aug. 21, 2020 (DE) ..... 10 2020 005 128.6

(51) Int. Cl.
*E21B 10/40* (2006.01)
*E21B 7/26* (2006.01)

(52) U.S. Cl.
CPC ..... *E21B 10/40* (2013.01)

(58) Field of Classification Search
CPC ..... E21B 4/145; E21B 4/14; E21B 4/06; E21B 7/26; E21B 10/40; E21B 7/30
See application file for complete search history.

(56) References Cited

U.S. PATENT DOCUMENTS 681,381 A * 8/1901 Wallace ..... E21B 10/40 175/416
738,327 A * 9/1903 Higgins ..... E21B 10/40 175/391
2,209,619 A * 7/1940 Wilcox ..... E21B 10/40 175/398
2,648,524 A * 8/1953 Dionisotti ..... E21B 10/58 175/413
3,507,342 A * 4/1970 Hasewend ..... H03H 17/02 175/62
4,100,979 A * 7/1978 Schmidt ..... E21B 7/26 175/19
4,193,461 A * 3/1980 Lamberton ..... E21B 4/20 175/171
4,462,468 A * 7/1984 Jenne ..... E02D 7/02 173/121
5,085,285 A * 2/1992 Elsby ..... E21B 4/14 175/425

(Continued)

FOREIGN PATENT DOCUMENTS

DE 25 58 842 A1 7/1977
DE 101 12 985 A1 10/2002

(Continued)

*Primary Examiner* — Kipp C Wallace
(74) *Attorney, Agent, or Firm* — Leason Ellis LLP

(57) ABSTRACT

A drilling head for a percussive displacement ground drilling device with a first drilling head section and a second drilling head section, the first drilling head section having discharge ducts, and the second drilling head section having a cross section that increases in the longitudinal direction, wherein the second drilling head section includes a plurality of step-shaped areas.

13 Claims, 1 Drawing Sheet

(56) References Cited

U.S. PATENT DOCUMENTS

| | | | | |
|---|---|---|---|---|
| 5,339,909 | A | 8/1994 | Jenne et al. | |
| 10,975,664 | B2 * | 4/2021 | Instone | E21B 37/02 |
| 2004/0112638 | A1 | 6/2004 | Hofmann | |
| 2006/0162965 | A1 | 7/2006 | Hadin | |
| 2008/0029307 | A1 * | 2/2008 | Green | E21B 21/12<br>175/296 |
| 2009/0211812 | A1 * | 8/2009 | Puttmann | E21B 4/145<br>175/21 |
| 2020/0347678 | A1 * | 11/2020 | Välisalo | E21B 4/14 |

FOREIGN PATENT DOCUMENTS

| | | | |
|---|---|---|---|
| DE | 10 2004 032 551 | A1 | 1/2006 |
| EP | 0548588 | A1 | 6/1993 |
| EP | 2663726 | A1 | 11/2013 |
| WO | 2006002997 | A1 | 1/2006 |

* cited by examiner

DRILLING HEAD FOR A PERCUSSIVE DISPLACEMENT GROUND DRILLING DEVICE AND USE OF A DRILLING HEAD FOR A PERCUSSIVE DISPLACEMENT GROUND DRILLING DEVICE

SUMMARY

The invention relates to a drilling head for a percussive displacement ground drilling device with a first and a second drilling head section, the first drilling head section having discharge ducts and the second drilling head section having a cross section that increases in the longitudinal direction, the second drilling head section having several step-shaped areas.

"Drilling head for a percussive displacement ground drilling device and use of a drilling head for a percussive displacement ground drilling device"

FIELD OF INVENTION

The invention relates to a drilling head for a percussive displacement ground drilling device and a use of a drilling head for a percussive displacement ground drilling device.

BACKGROUND

For the insertion of earth boreholes into the soil, ground drilling devices are known that can be designed, for example, as a percussion drilling machine or percussion drilling device.

DE 25 58 842 A1 discloses a percussion drilling machine with a displacement cone, the outer circumference of which exhibits knife-like cutting edges, which comminute solid obstacles, such as stones, very quickly. The knife-like cutting edges can be arranged one behind the other, offset in steps. A percussion drilling machine that has a tubular housing and an axially movable impact tip is described. In its area outside the housing, the impact tip has a displacement cone, which tapers toward the front and which is seated with a central bearing bore on a conical intermediate piece of the impact tip. The impact tip, which can be designed as a hollow chisel, for example, is pushed forward together with the displacement cone when it is impacted from behind. While the chisel-like part of the impact tip serves to comminute the stones, the purpose of the displacement cone is to divert the earth to the side and to create a cavity with a compacted side wall so that a solid passage is formed as the percussion drilling machine moves forward. The displacement cone can essentially be described as a stepped head or stepped drilling head, as is also known from DE 101 12 985 A1.

DE 10 2004 032 551 A1 discloses a drilling head for creating or widening a borehole by means of a percussively driven device. A drilling head with two drilling head sections is described. The first drilling head section has discharge ducts and can be used to loosen the soil or to comminute obstacles. The second drilling head section has conical sections on the lateral surface and can ensure the radial compaction of the loosened soil. The first drilling head section can essentially be described as a crown head or a crown drilling head, which has cutting edges running transverse to the length of the drilling head, between which there are discharge ducts for passage of the drill cuttings or the fragments of the obstacles that have been comminuted.

SUMMARY

Although the known ground drilling devices show good results in the insertion of earth boreholes, it is an object of the invention to provide an improved drilling head for a ground drilling device or an improved use of a drilling head for a ground drilling device, thereby achieving an improvement in performance for creating an earth borehole and/or an improvement in the service life of the drilling head.

The core idea of the invention is to provide a combination in which a drilling head section is designed as a crown head and a drilling head section is designed as a stepped head. Despite the designs previously only provided as incompatible alternatives, in which the design was either a crown head or a stepped head, it was recognized that the drill cuttings, for example in the form of stones, (clumped) soil, etc., can be rotated or pressed outward into the borehole wall by means of the steps of the stepped head. It was recognized for the first time that the hard constituents can be levered into the borehole wall. The drilling head section designed as a crown head can destroy existing obstacles, such as stones, and then the fragments of the obstacles can be levered outward into the borehole wall by means of the drilling head section designed as a stepped head. According to a core concept of the invention, the drilling head section designed as a crown head can first cut through the soil. Obstacles in the form of rocks that are larger than the passages/discharge ducts in the crown head can be comminuted. In this way, it can be achieved that only appropriately small obstacles have to be screwed or levered into the soil, meaning that the reaction forces that could lead to the deflection of the drilling head remain low. Since the screwing in of obstacles can occur behind the drilling head section designed as a crown head, as the drilling head section designed as a crown head runs ahead, it can also serve as a track and thus improve the directional stability of the drilling head.

A drilling head for a percussive displacement ground drilling device with a first and a second drilling head section is established. The first drilling head section has discharge ducts, and the second drilling head section has a cross section that increases in the longitudinal direction. The second drilling head section has several step-shaped areas.

The teaching of the invention constitutes added value for the user of the drilling head or a ground drilling device having the drilling head in that the skin friction on the housing of the drilling head that follows the two drilling head sections can be reduced. In this way, the negative influences of the otherwise higher skin friction on the performance or the advancing of the ground drilling device can be reduced. The wear of the housing following the two drilling head sections can also be reduced. The drilling head section designed as a crown head can take over the work of destroying obstacles present along the earth borehole to be created, and the steps of the drilling head section designed as a stepped head convey the fragments of the obstacles outward into the borehole wall and can thereby in particular lever them into the borehole wall by levering or screwing a fragment engaged by a step into the borehole wall. In this way, a reduction in the skin friction on the subsequent housing and/or a reduction in wear on the subsequent housing is achieved in the simplest manner.

In the context of the description, the term "ground drilling device" comprises any device that in particular moves a drill string having a rod section in an existing passage in the soil, or in one that is to be created, to create or widen a borehole, in particular a horizontal drill hole (HD), or to pull pipelines or other long bodies into the soil. The ground drilling device can in particular be a horizontal directional drill. A ground drilling device can thus be a device driving a drill string that works by displacing soil, wherein the drill string penetrates the soil in a translational and/or rotary manner in the longitudinal axial direction of the drill string. A borehole can be created or widened by moving the drill string forward and/or backward in the soil. The circumferential boundary of the passage or the earth borehole is usually called the borehole wall. The drill string can comprise the drilling head and sections connected to it that are moved together with the drilling head in the soil.

The term HD (horizontal drilling) in the context of the present description comprises in particular a borehole or a conduit or pipeline that is at least partially horizontal.

The term "soil" in the sense of the present description comprises in particular any type of material, in particular earth, sand, rock, stone, and mixed forms thereof, into which passages or boreholes exist or are to be created, preferably at least partially horizontally, in particular earth passages including earth boreholes, rock boreholes, or earth conduits as well as underground or above-ground pipelines and water channels that can be created or pulled in by using a suitable device for drilling in the soil.

A percussive displacement ground drilling device can be designed as a percussion drilling device. The term "percussion drilling device," or "displacement hammer," which is essentially used synonymously with the term "percussion drilling device," comprises in the context of the description a self-propelled impact device that displaces the soil and can introduce a borehole, a line, and/or a pipe into the soil by impact. The term "percussion drilling device" comprises soil displacement devices in which a drilling head tip that is longitudinally movable can be located in a housing. Alternatively, a drilling head tip can have a fixed position in the housing. The drilling head tip can in particular be a drill bit. A percussion drilling device can be a one-stroke device or a multi-stroke device, in particular a two-stroke device. With a one-stroke device, the main piston strikes the drilling head tip and simultaneously strikes the housing. In the case of a multi-stroke device, in particular a two-stroke device, in which the drilling head tip in particular can be moved longitudinally in the housing, the main piston first strikes the drilling head tip, which runs ahead in the first stroke. The housing is acted upon by the main piston in a subsequent stroke, in particular in the second stroke. In a multi-stroke device, tip resistance and skin friction are separated and alternately more easily overcome. In the case of a multi-stroke device, in particular a two-stroke device, energy transmission can be improved, which in particular facilitates the comminution of obstacles as a result of the concentration of the percussion impulse on the drilling head tip. As a result of the earth displacement corresponding to the stroke length of the drilling head tip running ahead, the housing remains in a steady position, thereby ensuring relatively good driving stability.

The term "drilling head" in the context of the description is a section, unit, or element located at the end that has an outwardly directed or exposed end that comes into contact with the soil during drilling. The drilling head forms the front area of the drill string, which, in order to penetrate the earth borehole into the soil, first comes into contact with the soil to be displaced, given that the drill string moves in the forward direction. The outwardly directed end of the drilling head can have an impact tip or drilling head tip, in particular in the form of a chisel. The impact tip can have a step-shaped geometry, and it preferably has a cutting edge.

The term "drilling head section" in the context of the description comprises a section of the drilling head that extends in a direction along the longitudinal axis of the drilling head. A drilling head section in the context of the description is characterized by its functionality when creating the earth borehole, wherein essentially two drilling head sections can be distinguished. Each of the several drilling head sections is in particular arranged one behind the next with respect to the longitudinal axis of the drilling head. One of the drilling head sections can in particular be designed as a crown head section and one of the drilling head sections as a stepped head section. In a preferred embodiment, exactly two drilling head sections are provided, one of which is a stepped head section and the other a crown head section. In particular, the crown head section is arranged in front of the stepped head section in the advancing direction, or forward direction, of the ground drilling device.

In the context of the description, the term "discharge duct" comprises an intermediate space between two projections that enables drill cuttings or penetrated soil to be discharged essentially along the longitudinal axis of the drilling head. The drill cuttings can be diverted along the drilling head by means of a discharge duct. There can be a relative movement between the soil and the drilling head through the discharge duct.

The term "along" the longitudinal axis of the drilling head is to be understood in particular as a direction that forms an angle with the longitudinal axis of the drilling head of <90°, preferably between 0° and 45°, more preferably between 0° to 30°.

The projections can extend in a direction along the longitudinal axis of the drilling head wherein the projections have a section that extends at an angle to the longitudinal axis of the drilling head of <90°, preferably at an angle of 0° to 45°, more preferably 0° to 30°. The projections can have a section that extends essentially transverse to the longitudinal axis, wherein the projections can extend with this section radially from the longitudinal axis. In this way, the projections and the intermediate spaces or discharge ducts between the projections can extend radially away from the longitudinal axis in relation to a cross section through the longitudinal axis, in particular in the form of a front face, and also extend along the longitudinal axis. The shape of the projection can change along the longitudinal axis. The discharge duct between two projections can have a constant or varying shape. In particular, the bottom of the discharge duct, viewed in the longitudinal direction of the drilling head, can have an angle. Viewed in cross section, the bottom of the discharge duct between two adjacent projections can be rounded.

In the context of the description, the term "step-shaped area" comprises a drilling head section that varies with regard to its circumference. In a step-shaped area, there are at least two areas, which, starting from the drilling head tip, have different diameters such that the diameter adjacent to the tip is smaller than the diameter farther from the drilling head tip. With the different circumferences, at least two plateaus can thus exist, which can run essentially parallel to the longitudinal axis, whereby angles to the longitudinal axis are possible in the range of 0° to 40°, preferably 0° to 30°, preferably 0° to 20°, more preferably 0° to 10°. Between the plateaus is a surface running transverse to the longitudinal axis that can define a step height, which forms an angle with the longitudinal axis of 10° to 90°, preferably 20° to 90°, preferably 30° to 90°, preferably 40° to 90°, preferably 50° to 90°, preferably 60° to 90°, preferably 70° to 90°, preferably 80° to 90°. The at least two sections extending in the circumferential direction, in particular in the form of plateaus, form an area with a surface extending along the longitudinal axis and in the circumferential direction, which can be regarded as a step, analogous to a stairstep. A section referred to as the slope extends between the surfaces and runs transverse to the longitudinal axis of the drilling head in the circumferential direction. The section extending transverse to the longitudinal axis of the drilling head in the circumferential direction essentially results in a step height.

It is described that the steps of the stepped head can be formed completely around the longitudinal axis of the drilling head, so that drill cuttings or debris passed through a discharge duct that come to the step or steps of a step section behind a crown head section can be screwed or levered into the wall of the borehole passage. In particular, the stepped head section can have a step that can be formed around the entire circumference of the longitudinal axis. In forming the steps fully around the entire circumference, each piece of drill cutting or debris can be engaged by the stepped head section. In one embodiment, it is precisely stipulated that behind a discharge duct of the crown head section, there is a stepped head section, arranged from the perspective of the longitudinal direction. Deflection of the drill cuttings can occur directly into the wall of the borehole. The material crushed by the crown head section can be directed into the discharge duct, hit the step of the stepped head section, and be pressed into the wall of the borehole. For the geometric design of the drilling head, this can mean that a stepped head section can be arranged with its step behind a discharge duct (corresponding to the angular section of the discharge duct). Drill cuttings diverted through the discharge duct can be engaged by the stepped head section.

In a preferred embodiment, the step-shaped areas are designed without cutting edges in the circumferential and/or radial direction. It can thus be achieved that the fragments or comminuted obstacles are essentially not further crushed or comminuted in the step-shaped drilling head section, but rather are screwed into the inner wall of the borehole or the borehole wall. This results in a fundamentally clear demarcation between the comminuting work of the front drilling head section and the displacement work of the following drilling head section.

In a preferred embodiment, there are two step-shaped areas in the second drilling head section. It has surprisingly been found that too low a step height (i.e., the radially extending distance between the two plateaus of two steps) leads to drill cuttings collecting in the area that connects the two steps (step height) (i.e., the area that extends radially), clogging the steps, possibly developing a directionally unstable, conical head. If the step height is too low, which would be particularly useful for a lever, for example, even small rock inclusions are sufficient to deflect the drilling head from the desired direction. Given the fact alone that a reduction in the number of steps leading to an increase in the height of the steps contradicts the original approach of screwing the drill cuttings into the borehole wall, the number of steps may constitute an essential aspect of the invention, if not indeed an aspect that is an independent basis for the invention. Alternatively, it is possible for the second drilling head section to have more than two step-shaped areas. If there are more than two step-shaped areas, three or four step-shaped areas are preferred.

In a preferred embodiment, the step-shaped areas have essentially the same step heights, whereby a second drilling head section with a particularly simple construction is possible. Furthermore, with the same step height, a distribution can take place in such a way that neither of the two possible step heights is specified such that it is too small.

In a preferred embodiment, at least one—preferably several, particularly preferably all—of the step-shaped areas has a step height that, based on the diameter of the housing of the ground drilling device, in particular the housing of a percussion drilling device, is at least 4% of the diameter of the housing, preferably at least 5%, more preferably at least 6%, more preferably at least 7%, more preferably at least 8%, more preferably at least 9%, more preferably at least 10%, more preferably at least 11%, more preferably at least 12%, more preferably at least 13%, more preferably at least 14%, more preferably at least 15%. This takes into account the consideration of avoiding a step height that is too small, which can become clogged with drill cuttings and then lead to a directionally unstable drilling head section.

In a preferred embodiment, at least one—preferably several, particularly preferably all—of the step-shaped areas has a step length or plateau length or tread that, based on the diameter of the housing of the ground drilling device, in particular the housing of a percussion drilling device, is at least 5% of the diameter of the housing, preferably at least 7%, more preferably at least 10%, more preferably at least 12%, more preferably at least 15%, more preferably at least 17%, more preferably at least 20%, more preferably at least 25%, so that a separation of the step-shaped areas can take place, which prevents a nullification or binding of the step-shaped areas even in the event of deposits or soiling. A corresponding step length can improve the screwing in of individual fragments, which should preferably take place incrementally, since the fragments can otherwise be engaged by several step-shaped areas at the same time.

In a preferred embodiment, the step-shaped area farthest from the exposed end of the drilling head (i.e., the drilling head tip) projects beyond the diameter of a subsequent section of the drill string. In this way, it can be achieved that by means of the step-shaped area that is farthest from the drilling head tip and thus the last step-shaped area in the advancing direction, there is an outside diameter that in particular projects beyond the outside diameter of the housing of the ground drilling device, in particular the housing of a ground drilling device designed as a percussion drilling device in the drill string. In this way, the skin friction of the housing can be reduced, and the advancement rate of the ground drilling device can be increased, resulting in added value for the user. In addition to improved advancement rate, the maintenance for the ground drilling device itself is reduced and the service life is increased. In a preferred embodiment, the diameter of the last step-shaped area is 5% larger than the diameter of a subsequent section of the drill string, in particular the housing of the ground drilling device designed as a percussion drilling device, preferably 7% larger, more preferably 10% larger, even more preferably 12% larger than the diameter of the housing.

In a preferred embodiment, at least one of the projections delimiting a discharge duct projects beyond the diameter of the second drilling head section and/or a subsequent section of the drill string. In this way, it can be achieved that the projections of the first drilling head section that serve as cutting edges are larger in diameter than the diameter of the second drilling head section, which leads to the advantage that the at least one projection can drive through the soil like a plow and scratch the borehole wall, whereby the drill cuttings can subsequently embed themselves more easily in the borehole wall. By driving through the soil beyond the boundaries of the actual borehole, the borehole wall is loosened at least in these areas, and the drill cuttings, which essentially correspond to the entire volume of the drilling head, can be introduced more easily into the borehole wall. In a preferred embodiment, the diameter with the projections is 5% larger than the diameter of the second drilling head section, preferably 7% larger, more preferably 10% larger, even more preferably 12% larger.

In a preferred embodiment, at least four, preferably six, projections are provided, which form four or six discharge ducts. As a result, a very good advancement rate can usually be achieved, with which possible rocks or obstacles can be comminuted sufficiently small. Four projections are advantageous if a smaller front face and fewer lateral friction surfaces can support advancing with otherwise the same force of impact, which is the case, for example, with loose soil (for example, sand or clay). In the case of harder terrain, six projections may be preferable, with a larger front face and more friction surface laterally.

In a preferred embodiment, the step height (slope) is less than a third of the width of a discharge duct. In this way, a suitable dimension can be set at which the step height for screwing the fragments or comminuted obstacles into the borehole wall can be adjusted to the size of the fragments or comminuted obstacles. As a result, the edge of the step-shaped sections or the tilting edge of a fragment can be arranged in such a way that the tilting edge lies essentially below the center point/center of gravity of a fragment. In a preferred embodiment, the step height may be a minimum step height of 1/20 the width of a discharge duct in combination with or as an alternative to the designated maximum dimension of step height. It can be provided that the size of the step height, based on the width of a discharge duct, is in the range of 1/20 to 1/3 the width of the discharge duct, more preferably in the range of 1/18 to 1/3, more preferably in the range of 1/16 to 1/3, more preferably in the range of 1/14 to 1/3, more preferably in the range of 1/12 to 1/3, more preferably in the range of 1/10 to 1/3, more preferably in the range of 1/8 to 1/3, more preferably in the range of 1/6 to 1/3, more preferably in the range of 1/5 to 1/3, and more preferably in the range of 1/4 to 1/3.

The invention also establishes a use of a drilling head for a percussive displacement ground drilling device with a first and a second drilling head section, wherein a drilling head section with discharge ducts is used as the first drilling head section, which destroys obstacles, and a drilling head section with a cross section that increases in the longitudinal direction is used as the second drilling head section, wherein several stepped-shaped areas are used for the second drilling head section, which can be used for rotating and/or turning of debris of the obstacles in to the borehole wall.

In the context of the description, the naming of relative data based on another variable, given as a percentage or as a fraction of a reference variable, comprises not only the actual resulting numerical value, but also—in particular to take into account manufacturing tolerances—a range around the resulting concrete numerical value, provided that the reference value is used, which can be +/−15%, preferably +/−10%, of the resulting numerical value.

The term "have" in the context of the description comprises not only the inherent meaning of the term that further elements can be provided in addition to the elements mentioned (non-exhaustive list), but also the significance that the term "have" is synonymous with "consist of" or "formed from" (exhaustive list).

Neither the above statements of nor the following description of exemplary embodiments constitute a waiver of any particular embodiments or features.

BRIEF DESCRIPTIONS OF DRAWINGS

The invention is clarified below by way of example with reference to the exemplary embodiments shown in the figures.

The Drawings Show:

DETAILED DESCRIPTION

Figure 1:
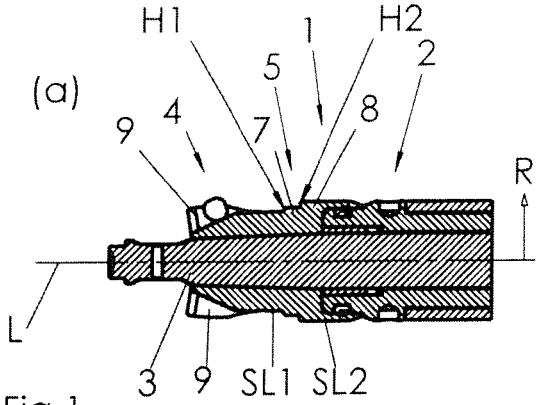
FIG. 1 illustrates a front section of a drilling head in a longitudinal section (a) and a front view (b), in which the comminution of an obstacle is shown by way of example using debris from an obstacle.
Figure 1:
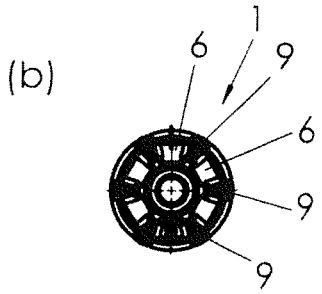

FIG. 1 shows, in a longitudinal section (a) and in a front view (b), a front section of a drilling head 1 for a percussive displacement ground drilling device. The drilling head 1 has a housing 2 in which a drilling head tip 3 in the form of a drill bit is located. In the front area of the drilling head 1, a first and a second drilling head section 4, 5 are arranged around the drilling head tip 3. The drilling head sections 4, 5 are formed in one piece as an attachment on the drilling head 1. The first drilling head section 4 has discharge ducts 6. The second drilling head section 5 has a cross section that increases in the longitudinal direction L. The second drilling head section 5 also has several step-shaped areas 7, 8.

The step-shaped areas 7, 8 are designed without cutting edges in the circumferential direction and in the radial direction R. The step-shaped areas have a step height H1, H2 and a step length SL1, SL2.

Figure 2:
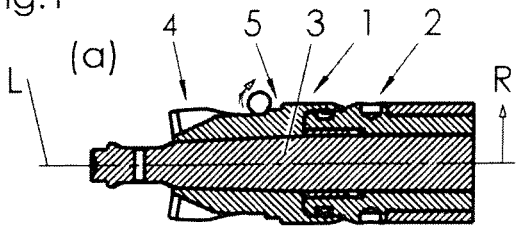
FIG. 2 through 4 illustrate the longitudinal section (a) and the front view (b) according to FIG. 1 with the further trajectory of the debris.
Figure 2:
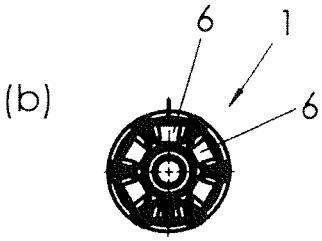
Figure 3:
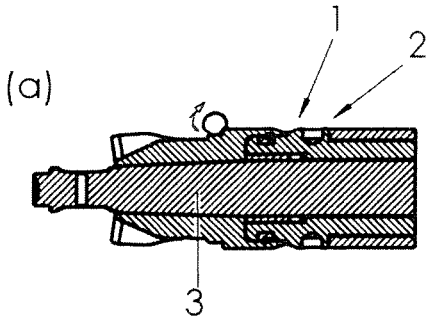
Figure 3:
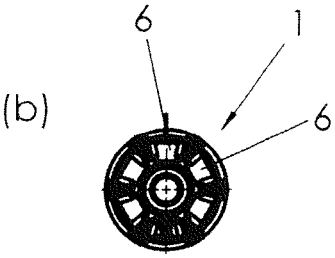
Figure 4:
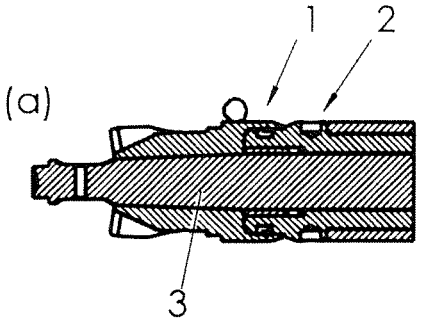
Figure 4:
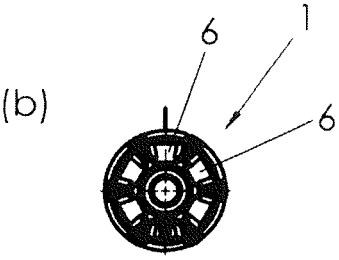

FIG. 1 shows how an existing obstacle is comminuted with the first drilling head section 4 and how a fragment of the obstacle passes through one of the discharge ducts 6 in the longitudinal direction L of the drilling head 1 when the drilling head 1 moves. When the fragment reaches a step of the step-shaped areas 7, 8, the fragment is rotated according to the arrow shown in FIG. 2 and essentially screwed into the borehole wall. The screwing in or levering in of the fragment of the obstacle is shown in FIGS. 2 and 3 for each of the two steps. It is implied in FIG. 4 that the fragment of the obstacle was embedded or screwed into the borehole wall.

Figure 5:
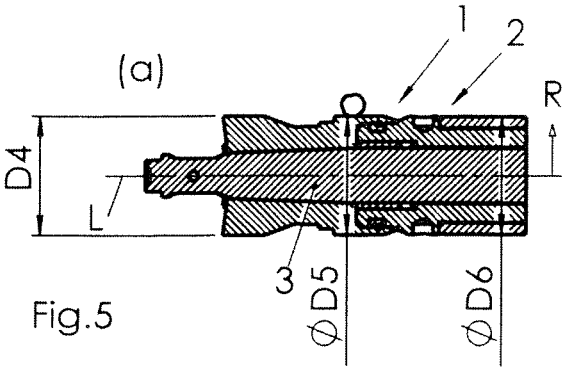
FIG. 5 illustrates a further embodiment of a front section of a drilling head shown in a longitudinal section and in a front view.
Figure 5:
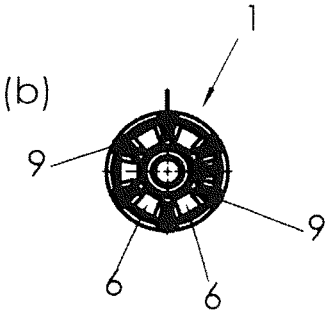

The embodiment shown in FIG. 5 differs essentially from the embodiments shown in FIGS. 1 through 4 in that the projections 9 of the first drilling head section 4 delimiting the discharge ducts 6 protrude beyond the circumference or diameter of the second drilling head section 5. In addition, the second drilling head section 5 protrudes beyond the circumference or the diameter of the housing 2, wherein, in an embodiment not shown, the second drilling head section 5 does not protrude beyond the circumference or the diameter of the housing 2 and therefore essentially has a circumference or diameter that is less than or equal to the housing 2.

In FIG. 5, the diameter D4 of the first drilling head section 4 formed by the projections 9 is approximately 5% larger than the diameter D5 of the second drilling head section 5. The diameter D5 of the second drilling head section 5 is approximately 5% larger than the diameter D6 of the housing 2.

The invention claimed is:

1. Drilling head for a percussive displacement ground drilling device with a first and a second drilling head section, the first drilling head section having discharge ducts and the second drilling head section having a cross section that increases in a longitudinal direction, wherein the second drilling head section includes a plurality of step-shaped areas, wherein the step-shaped areas are configured without cutting edges in a circumferential direction and/or in a radial direction, wherein each of the step-shaped areas have a step height, wherein the step height is an increase in a radius of the second drilling head section provided by the step, and wherein each step height is between about 4% and 15% of a diameter of a housing of the ground drilling device, wherein the first drilling head section is arranged in front of the second drilling head section in an advancing or forward direction; of the ground drilling device, wherein the plurality of step-shaped areas are located behind the discharge ducts of the first drilling head section, such that the plurality of step-shaped areas engage drill cuttings diverted through the discharge ducts, wherein the engaged drill cuttings are deflected and pressed into a wall of a borehole.

2. Drilling head according to claim 1, wherein said plurality of step-shaped areas is two.

3. Drilling head according to claim 2, wherein the step-shaped areas have a step height that is essentially the same.

4. Drilling head according to claim 1, wherein the ground drilling device comprises a housing and at least one of the plurality of step-shaped areas has a step length with a magnitude of at least 5% of a diameter of the housing of the ground drilling device.

5. Drilling head according to claim 1, wherein at least one of said plurality of step-shaped areas, farthest from an exposed end of the drilling head, protrudes beyond a diameter of a subsequent section of a drill string of the drilling device.

6. Drilling head according to claim 1, wherein two projections delimit each discharge duct, and wherein at least one of the projections delimiting a discharge duct protrudes beyond a diameter of the second drilling head section and/or a subsequent section of the drill string.

7. Drilling head according to claim 6, wherein two projections delimit each discharge duct, and wherein at least four projections are provided, which form four discharge ducts.

8. Drilling head according to claim 1, wherein the step-shaped areas have a step height less than a third of a width of a discharge duct.

9. Drilling head according to claim 6, wherein two projections delimit each discharge duct, and wherein at least six projections are provided, which form six discharge ducts.

10. Drilling head according to claim 1, wherein two projections delimit each discharge duct, and wherein at least one of the projections delimiting a discharge duct protrudes beyond a diameter of the second drilling head section.

11. Drilling head according to claim 1, wherein two projections delimit each discharge duct, and wherein at least one of the projections delimiting a discharge duct protrudes beyond a diameter of a subsequent section of the drill string.

12. Drilling head according to claim 1, wherein exactly two drill head sections are provided and the first drilling head section is a crown head section and the second drilling head section is a stepped head section.

13. Drilling head according to claim 1, wherein the drilling head comprises a drilling head tip and in each of the step-shaped areas at least two areas exist, which, starting from the drilling head tip, have different diameters such that a diameter adjacent to the drilling head tip is smaller than a diameter farther from the drilling head tip.

* * * * *